US006282990B1

(12) United States Patent
Miner

(10) Patent No.: US 6,282,990 B1
(45) Date of Patent: Sep. 4, 2001

(54) FLAT HEAD POWER RATCHETS

(76) Inventor: Montie H. Miner, 3413 Maryville Rd., Granite City, IL (US) 62040

( * ) Notice: Subject to any disclaimer, the term of this patent is extended or adjusted under 35 U.S.C. 154(b) by 0 days.

(21) Appl. No.: 09/458,973

(22) Filed: Dec. 10, 1999

(51) Int. Cl.[7] ..... B25B 13/46

(52) U.S. Cl. ..... 81/57.39; 81/57.11; 81/62; 81/63.1

(58) Field of Search ..... 81/57.39, 57.11, 81/62, 63.1

(56) References Cited

U.S. PATENT DOCUMENTS 4,752,158 6/1988 Greenhill .
4,848,939 7/1989 Ludwig .
4,993,288 2/1991 Anderson et al. .
5,103,696 * 4/1992 Beuke .
5,450,773 * 9/1995 Darrah et al. .
5,535,646 7/1996 Allen et al. .
5,738,192 4/1998 Miner .
5,983,757 * 11/1999 Blise et al. .

* cited by examiner

*Primary Examiner*—Timothy V. Eley
*Assistant Examiner*—Willie Berry, Jr.

(57) ABSTRACT

A low profile substantially flat head power ratchet comprising a pair of spaced shells joined together to for a housing which is tubular at one end for attachment to a pneumatic motor and flat at the other end for operating use in confined areas, said ratchet comprising a gear journaled on a post in the upper shell and a boss on the lower shell, a yoke disposed about the gear and pivotally journaled about the boss, a pair of spaced pawls confined primarily in the yoke but projecting slightly upwards therefrom, and a reversing plate pivotally disposed about the post and lying on the yoke between the pawls, said reversing plate being shaped and sized such that only one of the two pawls may be selectively engaged with the gear at any one given time.

14 Claims, 6 Drawing Sheets

FLAT HEAD POWER RATCHETS

This invention relates to pneumatically operated ratchet tools.

BACKGROUND

There is a need for a low profile flat end pneumatically operated ratchet tool adapted for use in small areas where the conventionally sized ratchets cannot provide ready access. U.S. Pat. No. 5,736,192 was issued to me for a through hole ratchet containing a drive mechanism, which I have adapted to an anvil driven ratchet in such manner that power sufficient to drive smaller ratchet anvils in confirmed spaces is achieved, while the benefits of reduced wear and tool longevity is realized. This tool capability is achieved by utilizing the housing in conjunction with the moving parts as an operating part of the tool.

It is the object of this invention to provide a low profile flat head ratchet which utilizes its housing as an operating part of its mechanism and thereby enables ratchet to operate in confirmed areas which were previously inaccessible.

IN THE DRAWINGS

DESCRIPTION

Figure 1:
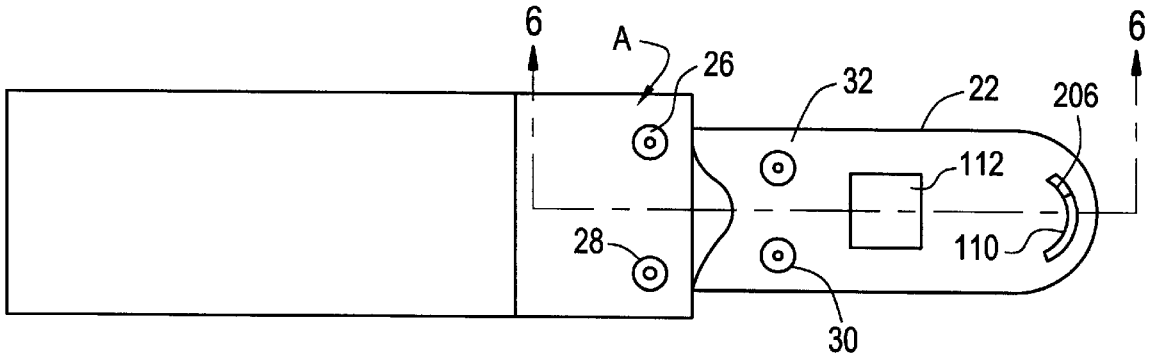
FIG. 1 is a top plan view of a preferred embodiment of my invention.
Figure 5:
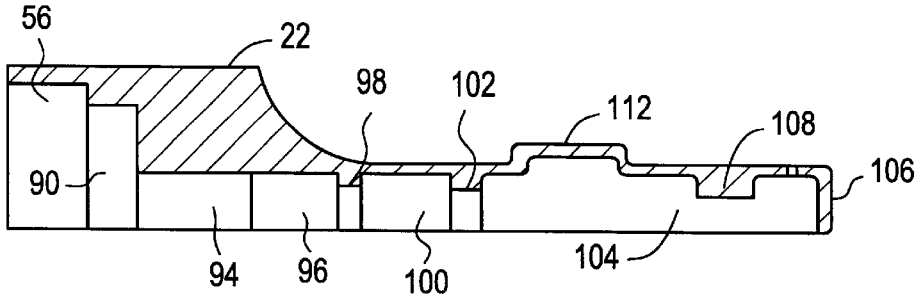
FIG. 5 is a sectional view taken along lines 5—5 of FIG. 4.
Figure 4:
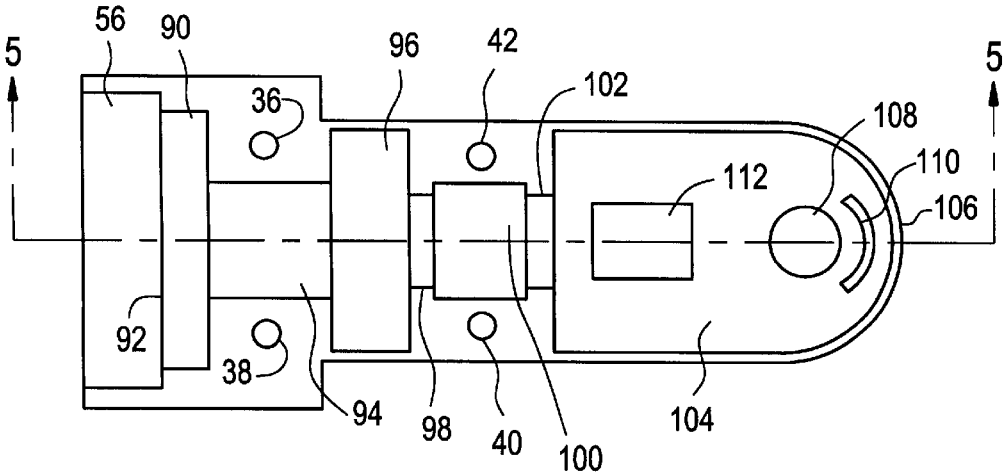
FIG. 4 is a plan view of the interior of the upper shell of my housing.
Figure 2:
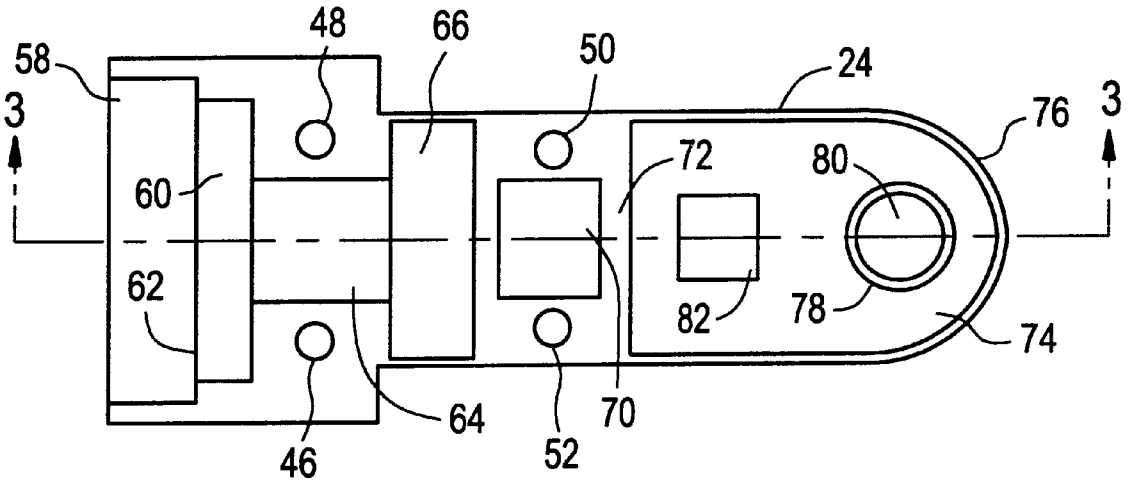
FIG. 2 is a plan view of the interior of the lower shell of my housing.
Figure 3:
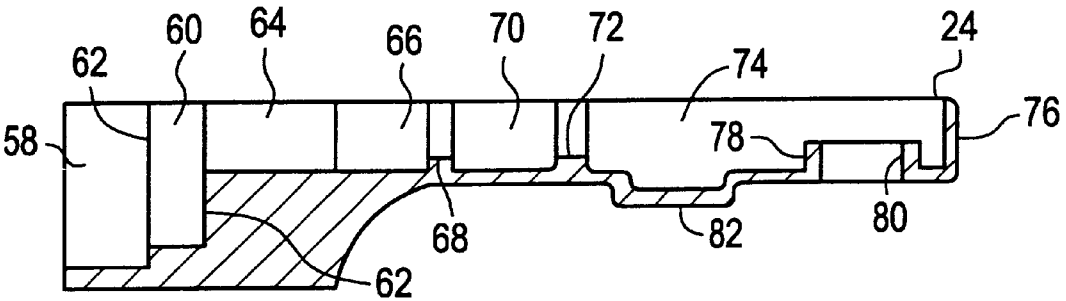
FIG. 3 is a sectional view taken along lines 3—3 of FIG. 2.

Referring now in more detail by reference character to the drawings, which illustrate a preferred embodiment of my invention, A designates a ratchet assembly comprising a housing 20 formed by an upper shell 22 and a lower shell 24 secured together by four screws 26, 28, 30 and 32, which extend through bores 36, 38, 40 and 42 in the upper shell 22 and are attached to threaded bores 46,48, 50 and 52 respectively in the lower shell 24. At one end, the housing 20 is provided with a threaded aperture 54 formed by complementary threaded sections 56, 58, in the shells 22 and 24 respectively, which aperture 54 is sized and shaped for conventional attachment to a conventional pneumatic motor B. At its other end, the housing 20 is substantially rectangular in cross section with preferably though not necessarily the height being less than half the width.

The lower shell 24 includes an arcuate recess 60 immediately adjacent the threaded section 56 defining a shoulder 62, an elongated arcuate channel 64, a rectangular recess 66, an arcuate shoulder 68, a bearing retaining channel 70, a second arcuate shoulder 72, and an enlarged chamber 74. Near the flat end 76, the shell 24 is provided with a raised annular boss 78 having an axial bore 80, all for purposes presently more fully to appear. Intermediate the shoulder 72 and the boss 78, the lower shell 24 is provided with an downwardly extending clearance relief 82, also for purposes presently more fully to appear.

The upper shell 22 includes an arcuate recess 90 immediately adjacent the threaded section 54 defining a shoulder 92, an elongated arcuate channel 94, a rectangular recess 96, an arcuate shoulder 98, a bearing retaining channel 100, a second arcuate shoulder 102, and an enlarged chamber 104. Near its end 106, the shell 22 is provided with an inwardly extending cylindrical post 108, and intermediate the shoulder 102 and the post 108, the upper shell 22 is provided with an outwardly projecting clearance relief 112. Intermediate the post 108 and the end 106, there is provided an arcuate slot 110. It should be here noted that the annular post 108 and the annular boss 78 are coaxial.

Figure 6:
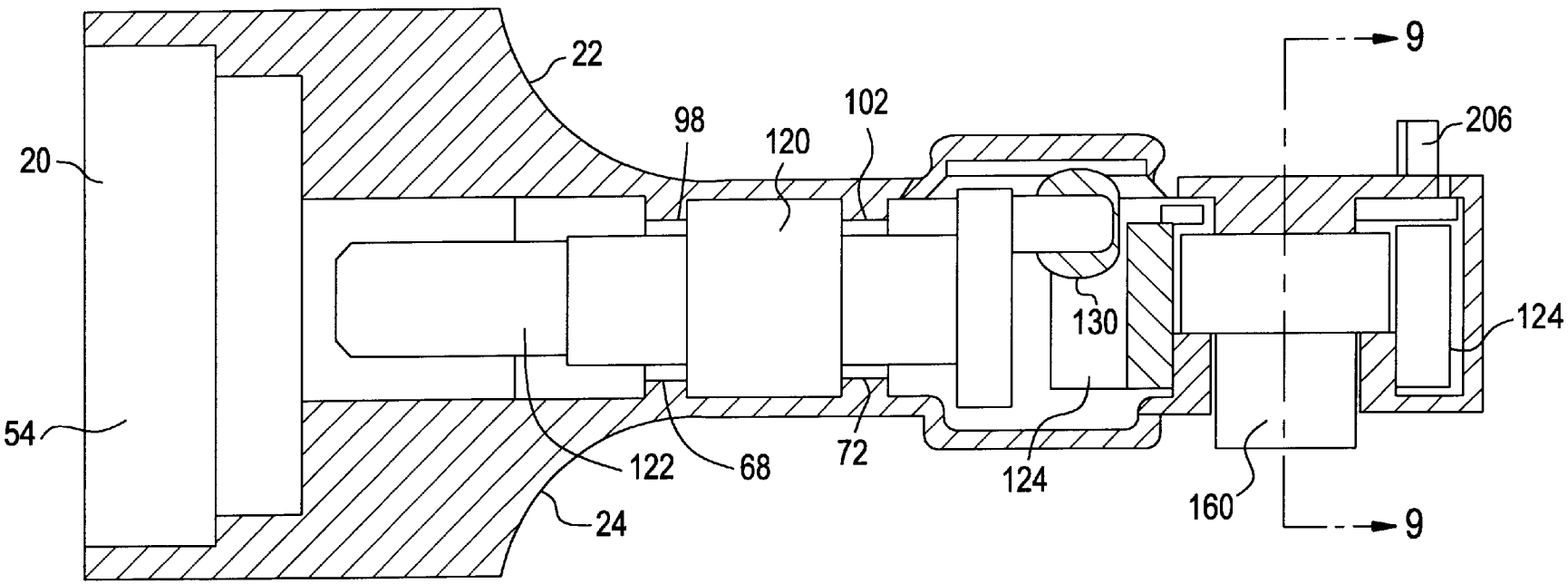
FIG. 6 is an enlarged fragmentary sectional view taken along lines 6—6 of FIG. 1.

Referring in detail to FIG. 6, mounted in the housing 20 in the space defined by the channels 70, 100, and retained therein between shoulders 68, 98, and 72, 102, is a crank bearing 120 in which is journaled a bell crank 122. Disposed in the space defined by the lower chamber 74 and the upper chamber 104 is a yoke 124 having a bore 126 sized for pivotal disposition about the cylindrical element 78.

Figure 7:
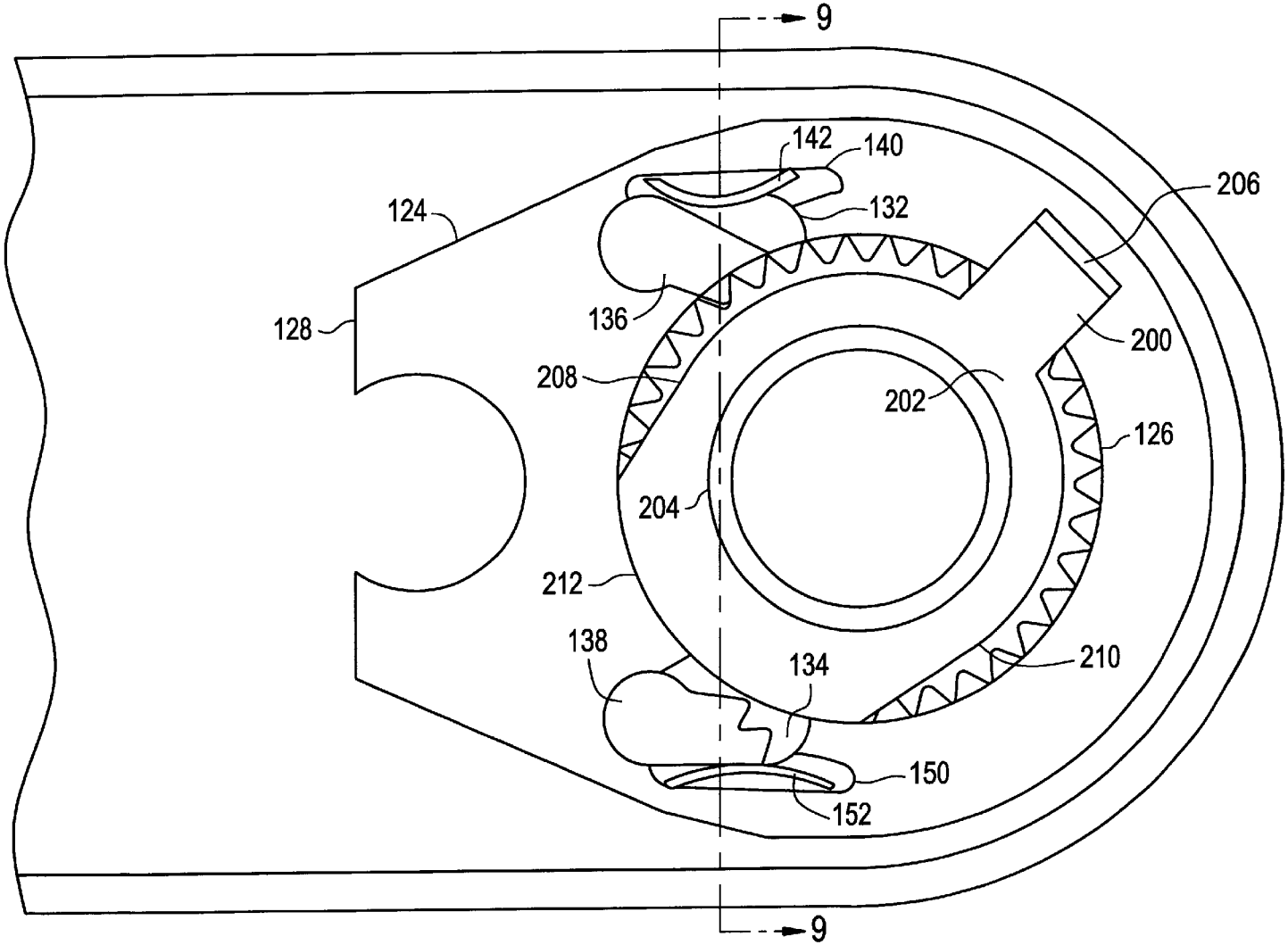
FIG. 7 is an upper plan view of a preferred embodiment of my invention with the upper shell removed.
Figure 8:
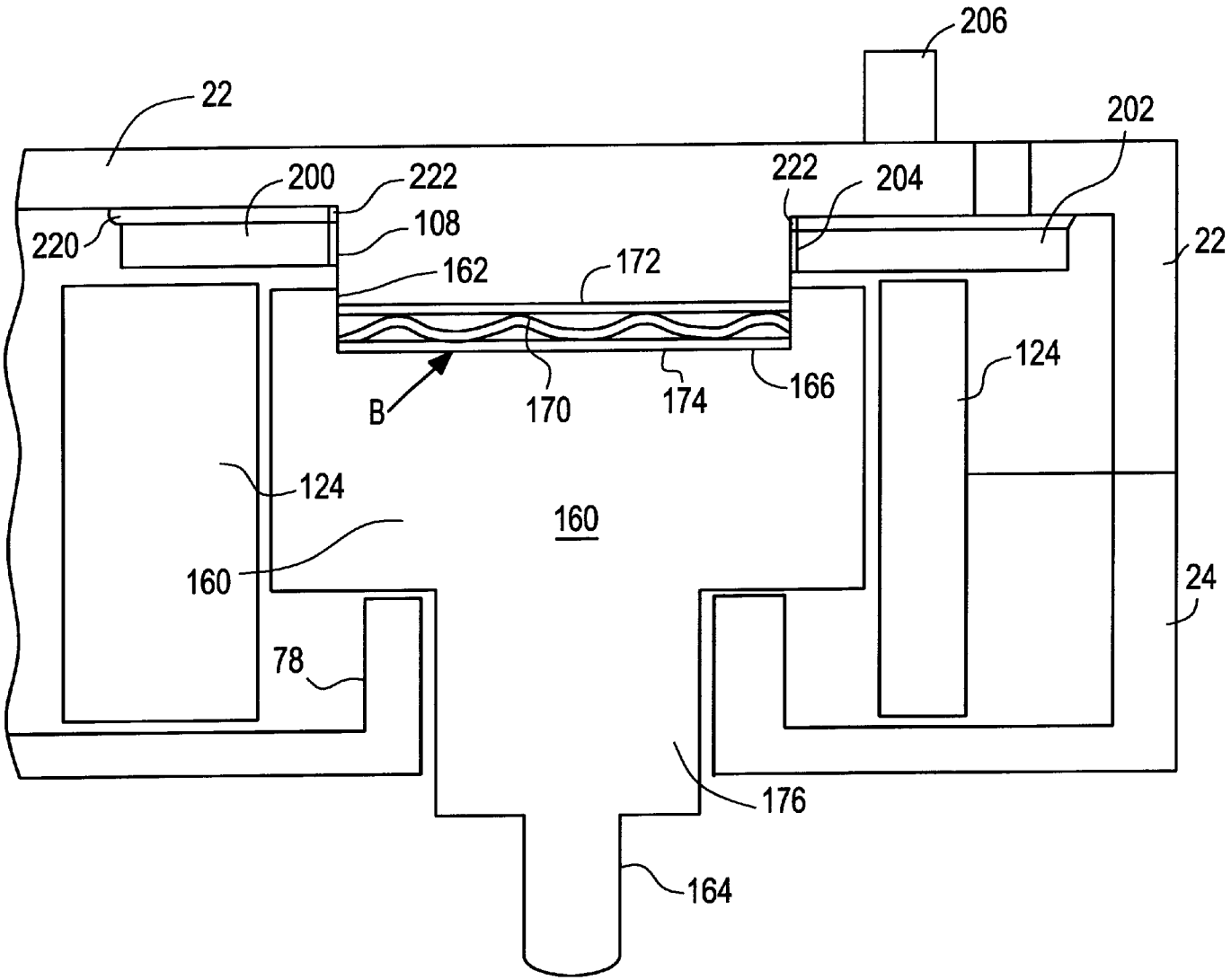
FIG. 8 is an enlarged sectional view taken along lines 8—8 of FIG. 7.
Figure 9:
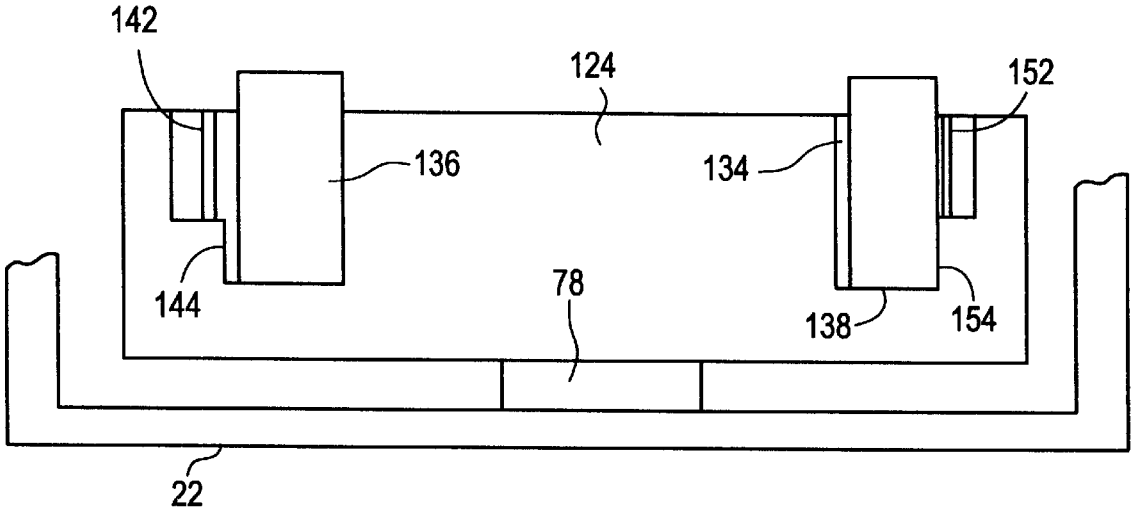
FIG. 9 is an enlarged fragmentary sectional view taken along lines 9—9 of FIG. 6.

Referring now to FIG. 7, the end 128 of the yoke 124 opposite the bore 126 is U-shaped and sized for accepting the bell crank ball 130 of the bell crank 122. On opposing sides of the bore 126, the yoke 124 is provided with a pair of complementary pawl chambers 132, 134, each respectively adapted to house a pawl 136, 138. Immediately adjacent to and in communication with the pawl chamber 136 is a spring chamber 140 in which is disposed a curved spring plate 142. The spring chamber 140 descends downwardly into the yoke 124, however, the spring chamber 140 is not as deep as the pawl chamber 132 creating a lower shoulder 144 which prevents the pawl 136 from entering the spring chamber 140. It should also be noted that the spring plate 142 and the spring chamber 140 are each longer that the pawl chamber 132 whereby the spring plate 142 is retained in the spring chamber 140 during movement of the pawl 136. Similarly, immediately adjacent to and in communication with the pawl chamber 134 is a spring chamber 150 in which is disposed a curved spring plate 152. The spring chamber 150 also descends downwardly into the yoke 124 to a lesser depth than the pawl chamber 134 creating a lower shoulder 154 which prevents the pawl 138 from entering the spring chamber 150. It should also be noted that the spring plate 152 and the spring chamber 150 are each longer that the pawl chamber 134 whereby the spring plate 152 is retained in the spring chamber 150 during movement of the pawl 138. As can best be seen in FIG. 8, it should also be noted that the pawls 136, 138, each extend above the upper surface of the yoke 124.

Rotatably disposed in the housing 20 between the post 108 and the element 78 is a drive gear 160 provided at one end with an axially extending annular recess 162 and at the other end with a square socket attachment post 164. Disposed between the end of the post 108 and the base 166 of the recess 162 is a washer sandwich 168 comprising a wave washer 170 disposed between an upper friction washer 172 and a lower friction washer 174. The drive gear 160 also includes a diametrically reduced intermediate segment 176 which is sized for close fitting but freely movable disposition in the bore 80 of the element 78. It should be here noted that the gear 160 is provided with gear teeth constructed at angles which will enable efficient engagement with the pawls 136, 138, (similar to the teeth on the gear described in U.S. Pat. No. 5,738,192 issued to me on Apr. 14, 1998 for Power Tool Drives), and similarly the teeth on each of my pawls 136, 138, are constructed of differing size and height as described in said patent. It should also be here noted that the axial length of the bore in my yoke 124 is longer than the axial length of my drive gear 160 such that the pawls 136, 138, will extend above the upper surface of the drive gear 160 as it is rotated between the post 108 and boss 78. It should be also noted that the orientation of the pawl chambers 132, 134, and the pawls 136, 138, respectively is similar to the orientation of the pawls and pawl chambers described in U.S. Pat. No. 5,738,192 such that once contact is made between either pawl and the teeth in drive gear 160, the teeth of the pawl will slip into full engagement with the teeth in the drive gear 160 and the pawl will backload itself snugly against the yoke 124, whereby to maximize torque while minimizing friction.

Disposed about the post 108 above the yoke 124 is a reverser 200 comprising a plate 202 provided with an aperture 204 sized for disposition about the post 108, an upwardly control lever 206, and a pair of complementary straight sides 208, 210. The end 212 opposite the lever 206 is arcuate and sized for movable disposition in the bore 126 as the lever 206 is moved about the post 108. The lever 206 projects upwardly through the slot 110 and the slot 110 is sized to limit the rotational movement of the lever 206 about the post 108 in the manner hereafter described. The reverser is sized and shaped such that when the lever 206 is at one end of the slot 110, the end 212 of the reverser 200 urges the pawl 138 away from teeth in the drive gear 160 and back against the spring 152 while the pawl 136 engages the teeth in the drive gear 160, and when the lever 206 is at the opposite end of the slot 110, the end 212 of the reverser 200 urges the pawl 136 away from teeth in the drive gear 160 and back against the spring 142 while the pawl 138 engages the teeth in the drive gear 160. Disposed between the upper surface of the reverser 200 and the top of the chamber 20 is a sheet 220 of durable low-friction material which is provided with a bore 222 which surrounds the post 108 and a shroud 224 which surrounds the lever 206.

OPERATION

When the tool A is threadedly attached to a conventional air motor at aperture 54, as the motor is actuated the bell crank 122 is rotated in the bearing 120 causing the yoke 124 to pivot alternately back and forth about the drive gear 160. With the lever 206 in its full counterclockwise position, the pawl 136 engages the teeth in the drive gear 160 while the end 212 of the reverser 202 urges the pawl 138 away from the teeth of the drive gear 160, causing the gear 160 to be driven in one rotational direction. Conversely, with the lever 206 in its full clockwise position, the pawl 138 engages the teeth in the drive gear 160 while the end 212 of the reverser 202 urges the pawl 136 away from the teeth of the drive gear 160, causing the gear 160 to be driven in the opposite rotational direction. Axial movement of the drive gear 160 during rotation is eliminated by the washer sandwich B which continuously provides a slight bias between the drive gear 160 and the boss 78, even during vibration.

The reverser 200 is movably disposed about the post 108 and is held in position by the pressure exerted on its end 212 by either the spring biased pawl 138 or the spring biased pawl 136, depending on the rotational direction selected for the drive gear 160. The sheet 220 of non-friction material allows the operator to move the lever 206 with his thumb and enables simple rotational direction changes without having to put the tool down. It should be here noted that each of the springs 142, 152, are sized in length such that spring bias is presented to the respective pawls 136, 138, as they are urged toward engagement with the teeth of the gear 160 and that upon a tooth of the selected pawl engaging a gear tooth, the bias provided by the spring 142, 152, is removed from the respective pawl and the shape of the tooth leads the respective pawl into complete engagement with the gear teeth. This unique and novel feature eliminates most of the wear on the pawl teeth and gear teeth caused by the return stroke of the yoke and greatly enhances the life of the tool. The combination of the pawls having different sized teeth, and the gear teeth being constructed at the angles as described in my U.S. Pat. No. 5,738,192 together with the removal of spring bias during the major portion of the forward and return strokes of the yoke, greatly increases the life expectancy of the tool by a factor of at least four.

It should further be noted that my invention is by its construction protected from exposure to outside elements such as debris and moisture in that the upper and lower shells are secured snugly together, the tubular end is attached to the pneumatic motor, and the only remaining place that outside contamination could enter is through the bore in the post which is protected by the lower part of the ear which fully convers the top of the boss as best seen in FIG. 6.

It should be apparent that changes and substitutions in the unique and novel arrangement, combination, assembly and interaction of the various parts and components shown and described herein may be made without departing from the nature and principle of my invention.

Having thus described my invention, what I claim and desire to secure by Letters Patent is shown in the drawings, described in the specification and claimed in the following claims:

1. A low profile flat head ratchet comprising an elongated housing having an upper shell and a lower shell, said housing having one flat end and one tubular end, said flat end being substantially shorter in height than in width, an annular boss in the lower shell having an annular bore which extends through the housing, said upper shell including an annular post which extends downwardly toward the boss, a gear rotatably mounted on the post and the boss, a yoke pivotally on about the gear, means for forcibly pivoting the yoke about the gear, pawl means for driving the gear in a preselected rotational direction as the yoke is pivoted about the gear, reversing means for selecting the rotational direction in which the gear will be driven, and socket attachment means integrally provided in the gear and projecting through the bore for driving an attached socket in the direction the gear is being driven.

2. The ratchet of claim 1 in which the gear is sized such that it covers the top of the boss whereby to prevent waste material and debris from entering the housing through the bore.

3. The ratchet of claim 1 in which the reversing means includes a plate disposed about the post, which plate includes lever means for positioning the plate about the post and also includes pawl selection means for selectively engaging the pawl means with the gear as the yoke is pivoted about the gear.

4. The ratchet of claim 1 in which the reversing means includes a plate disposed about the post, which plate includes a lever which extends outside the housing for positioning the plate about the post, the pawl means includes first and second spaced chambers provided in the yoke on opposing sides of the gear, first and second biasing means respectively disposed in said first and second chambers, first and second pawls respectively disposed in said first and second chambers in such manner that when the first pawl is engagement with the gear and the yoke is pivoted about the gear, the gear will be driven in a clockwise direction, and pawl selection means for selectively engaging either pawl with the gear as the yoke is pivoted about the gear.

5. The ratchet of claim 1 in which the pawl means includes first and second spaced chambers provided in the yoke, third and fourth chambers integrally provided in the first and second chambers respectively, said third and fourth chambers being shorter in depth than the first and second chambers, first and second pawls disposed respectively in the first and second chambers in such manner that when the first pawl is engagement with the gear and the yoke is pivoted about the gear, the gear will be driven in a clockwise direction, and when the second pawl is engagement with the gear and the yoke is pivoted about the gear, the gear will be driven in a counter-clockwise direction, biasing means mounted in the third and fourth chambers for biasing the first and second pawls toward the gear, and the reversing means includes pawl selection means for selectively engaging either pawl with the gear.

6. The ratchet of claim 1 in which the pawl means includes first and second spaced chambers provided in the yoke, third and fourth chambers integrally provided in the first and second chambers respectively, said third and fourth chambers being shorter in depth than the first and second chambers, first and second pawls disposed respectively in the first and second chambers in such manner that when the first pawl is engagement with the gear and the yoke is pivoted about the gear, the gear will be driven in a clockwise direction, and when the second pawl is engagement with the gear and the yoke is pivoted about the gear, the gear will be driven in a counter-clockwise direction, biasing means mounted in the third and fourth chambers for biasing the first and second pawls toward the gear, and the reversing means includes a flat plate disposed about the post between the upper shell and the upper face of the yoke, said flat plate having a periphery which includes an arcuate section and first and second straight sections, said straight sections being separated from each other by the arcuate section in such manner that when the first straight section is presented to the first pawl said pawl will be biased into engagement with the gear while the second pawl is held away from the gear by the arcuate section, and when the second straight section is presented to the second pawl said pawl will be biased into engagement with the gear by the biasing means while the first pawl is held away from the gear by the arcuate section, and manual means for selectively positioning a preselected straight section toward a preselected pawl.

7. The ratchet of claim 1 in which the pawl means includes first and second spaced chambers provided in the yoke, third and fourth chambers integrally provided in the first and second chambers respectively, said third and fourth chambers being shorter in depth than the first and second chambers, first and second pawls disposed respectively in the first and second chambers in such manner that when the first pawl is engagement with the gear and the yoke is pivoted about the gear, the gear will be driven in a clockwise direction, and when the second pawl is engagement with the gear and the yoke is pivoted about the gear, the gear will be driven in a counter-clockwise direction, biasing means mounted in the third and fourth chambers for biasing the first and second pawls toward the gear, and the reversing means includes a flat plate disposed about the post between the upper shell and the upper face of the yoke, said flat plate having a periphery which includes an arcuate section and first and second straight sections, said straight sections being separated from each other by the arcuate section in such manner that when the first straight section is presented to the first pawl said pawl will be biased into engagement with the gear while the second pawl is held away from the gear by the arcuate section, and when the second straight section is presented to the second pawl said pawl will be biased into engagement with the gear by the biasing means while the first pawl is held away from the gear by the arcuate section, and manual means for selectively positioning a preselected straight section toward a preselected pawl, said biasing means integrally including means for removing biasing forces from a pawl as the pawl is engaging itself with the gear.

8. A power ratchet comprising an upper shell and a lower shell, said upper and lower shells being joined together as an elongated housing which is tubular at one end and is provided with a chamber having slightly separated upper and lower faces at the other end, an annular post descending into the chamber from the upper shell, an annular boss extending upwardly into the chamber from the lower shell, an annular bore provided in the boss and extending through the boss and lower shell, a gear journaled between the post and the boss, said gear including an annular element which extends through the bore and is provided at its outer end with socket attachment means, a yoke pivotally disposed about the gear, means for pivoting the yoke in back and forth directions around the gear, first and second pawls disposed in the yoke, biasing means mounted in the yoke for biasing the first and second pawls into engagement with teeth in the gear, said pawls being mounted in such manner that when the yoke is pivoted back and forth and the first pawl is in engagement with the gear, the gear will be driven in a clockwise direction, and when the yoke is pivoted back and forth and the second pawl is in engagement with the gear, the gear will be driven in a counterclockwise direction, and reversing means for selectively placing either the first pawl or the second pawl into engagement with the gear teeth.

9. The ratchet of claim 8 in which the gear is provided with a first annular recess that overlaps the post in the upper shell, the post is provided with a second annular recess which is present toward the base of the recess in the gear, and the space between the recesses is filled with a washer sandwich comprising first and second flat washers with a wave washer in between, in such manner that axial wobble of the gear in the housing is eliminated as the gear is driven.

10. The ratchet of claim 8 in which the pawl teeth and gear teeth are constructed in such manner that once the first tooth of the pawl selected to engage a gear tooth begins to engage that gear tooth, the shape and angles of the teeth work together to cause the pawl teeth to become fully seated in the gear teeth, and the biasing means is removed from that pawl as seating occurs, whereby to reduce wear on the return stroke of the yoke.

11. The ratchet of claim 8 in which the biasing means comprises separate chambers on opposing sides of the yoke, and a blade spring disposed in each chamber sized for moving the pawl into engagement with the teeth in the gear when the reversing means does not interfere with the movement of that pawl.

12. The ratchet of claim 8 in which the biasing means comprises separate chambers on opposing sides of the yoke, and a blade spring disposed in each chamber sized for moving the pawl into engagement with the teeth in the gear, the paw is extend above the yoke, and the reversing means includes a plate disposed about the post and shaped such that by manually positioning the plate on the post, a preselected pawl can be allowed to engaged the gear while the other pawl is held away from the gear by the plate.

13. The ratchet of claim 8 in which the upper shell and lower shell are snugly fit together and the gear is constructed such that it will be fully seated on the top of the boss, whereby the interior components of the ratchet are protected from exposure to external debris and moisture.

14. A low profile ratchet comprising an elongated housing having an upper shell and a lower shell, said housing being tubular at one end and substantially shorter in height than in width at the other end, a gear journaled on an axis which extends between the between the upper and lower shells, a socket attachment post movable with the gear and projecting through the lower shell, a yoke pivotally disposed about the gear, driving means for pivotally moving the yoke back and forth about the gear, said yoke being provided with first and second spaced chambers, first and second biasing means respectively disposed in said first and second chambers, first and second pawls respectively disposed in said first and second chambers in such manner that when the first pawl is in engagement with the gear and the yoke is pivoted back and forth about the gear, the gear will be driven in a clockwise direction, and when the second pawl is in engagement with the gear and the yoke is pivoted back and forth about the gear, the gear will be driven in a counter-clockwise direction, and reversing means for selectively engaging either the first pawl or the second pawl with the gear, said reversing means including a plate disposed between the upper shell and the upper face of the yoke, third and fourth chambers integrally provided in the first and second chambers respectively, said third and fourth chambers being shorter in depth than the first and second chambers, said first and second chambers being less in depth than the height of the first and second pawls such that one edge of each pawl projects above the upper surface of the yoke, biasing means mounted in the third and fourth chambers for biasing the first and second pawls toward the gear, and pawl control means integrally provided in the plate and upper shell for directing a preselected pawl into engagement with the gear while simultaneously preventing the other pawl from engaging the gear.

* * * * *